US010619436B2

(12) United States Patent
Stone et al.

(10) Patent No.: US 10,619,436 B2
(45) Date of Patent: Apr. 14, 2020

(54) BALL ACTIVATED TREATMENT AND PRODUCTION SYSTEM INCLUDING INJECTION SYSTEM

(71) Applicants: Matthew C. Stone, Humble, TX (US); Jonathan N. Croy, Katy, TX (US)

(72) Inventors: Matthew C. Stone, Humble, TX (US); Jonathan N. Croy, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 224 days.

(21) Appl. No.: 15/679,489

(22) Filed: Aug. 17, 2017

(65) Prior Publication Data

US 2019/0055800 A1 Feb. 21, 2019

(51) Int. Cl.

| | |
|---|---|
| ***E21B 34/14*** | (2006.01) |
| ***E21B 21/10*** | (2006.01) |
| *E21B 21/00* | (2006.01) |
| *E21B 33/124* | (2006.01) |

(52) U.S. Cl.

CPC ..... *E21B 21/10* (2013.01); *E21B 34/14* (2013.01); *E21B 21/003* (2013.01); *E21B 33/1243* (2013.01)

(58) Field of Classification Search

CPC ..... E21B 34/14

See application file for complete search history.

(56) References Cited

U.S. PATENT DOCUMENTS

| | | | | |
|---|---|---|---|---|
| 3,503,445 | A * | 3/1970 | Cochrum | E21B 21/103 166/244.1 |
| 4,076,083 | A * | 2/1978 | Sizer | E21B 21/10 166/142 |
| 7,836,961 | B2 * | 11/2010 | Li | E21B 33/12 166/387 |
| 8,893,811 | B2 * | 11/2014 | Miller | E21B 34/10 137/614.11 |
| 10,260,314 | B2 * | 4/2019 | Saraya | E21B 34/063 |
| 2008/0093077 | A1 * | 4/2008 | Daccord | E21B 27/02 166/310 |
| 2017/0067314 | A1 * | 3/2017 | Flores Perez | E21B 34/10 |
| 2018/0094508 | A1 * | 4/2018 | Smith | E21B 43/26 |
| 2018/0347330 | A1 * | 12/2018 | Facca | E21B 34/14 |
| 2019/0218888 | A1 * | 7/2019 | Bacsik | E21B 34/14 |

* cited by examiner

*Primary Examiner* — Kipp C Wallace
(74) *Attorney, Agent, or Firm* — Cantor Colburn LLP

(57) ABSTRACT

A ball activated treatment and production system arranged between a first packer and a second packer includes a tubular including an inlet port, and an outlet port. A first sleeve is selectively slideably arranged in the tubular. The first sleeve includes a first ball seat and is arranged to selectively open the outlet port. A second sleeve is selectively slideably arranged in the tubular. The second sleeve includes a second ball seat and is arranged to selectively open the inlet port. At least one fluid injection port is arranged in the tubular and is fluidically connectable to a fluid conduit arranged externally to the tubular.

8 Claims, 3 Drawing Sheets

BALL ACTIVATED TREATMENT AND PRODUCTION SYSTEM INCLUDING INJECTION SYSTEM

BACKGROUND

In the drilling and completion industry, it is often desirable to isolate one portion of a well bore from another. In some cases, each portion of the well bore may be treated in order to stimulate production. Various tools may be used to operate sleeves disposed along a tubing string extending into the wellbore. For example, a drop ball may be introduced into a drill string to shift a sleeve and expose stimulation ports. Another drop ball may be introduced to shift another sleeve closing the stimulation ports and opening production ports.

Prior to initiating production, it is desirable to remove the drop balls from the tubing string. There are a number of techniques for removing drop balls. A tool may be run into the wellbore from a surface system to drill out the drop balls; the drop balls may be forced through corresponding ball seats by pressure introduced from the surface system. The use of tools is a time consuming and expensive undertaking. The use of pressure is also time consuming Drop balls may also be allowed to degrade. Specifically, drop balls may be made from a material designed to degrade when exposed to selected environmental factors.

It may be desirable to accelerate degradation of the drop balls. In such a case, an accelerant may be introduced into the tubular string to speed up degradation of the drop balls. The accelerant, typically a fluid having selected properties, is introduced into the tubular string and pumped down to the top most drop ball. Given the presence of fluid already in the tubular string, a large amount of accelerant is required to be introduced. The large amount of accelerant increases a likelihood that some of the accelerant will contact and react with the drop ball. This process is repeated for each drop ball until the tubular string is free of obstruction. Introducing an accelerant in this manner is a time consuming and expensive undertaking. Therefore, the industry would be receptive to more effective methods for removing drop balls.

SUMMARY

A ball activated treatment and production system arranged between a first packer and a second packer includes a tubular including an inlet port, and an outlet port. A first sleeve is selectively slideably arranged in the tubular. The first sleeve includes a first ball seat and is arranged to selectively open the outlet port. A second sleeve is selectively slideably arranged in the tubular. The second sleeve includes a second ball seat and is arranged to selectively open the inlet port. At least one fluid injection port is arranged in the tubular and is fluidically connectable to a fluid conduit arranged externally to the tubular.

A resource exploration and recovery system includes a surface system, a tubular string including a plurality of tubulars extending from the surface system. A first packer is provided on one of the plurality of tubulars. A second packer is arranged on one of the plurality of tubulars and another of the plurality of tubulars. The second packer is spaced from the first packer. A fluid conduit extends from the surface system through at least one of the first and second packers. A ball activated treatment and production system is arranged between the first packer and the second packer. The ball activated treatment and production system includes a tubular including an inlet port, and an outlet port. A first sleeve is selectively slideably arranged in the tubular. The first sleeve includes a first ball seat and is arranged to selectively open the outlet port. A second sleeve is selectively slideably arranged in the tubular. The second sleeve includes a second ball seat and is arranged to selectively open the inlet port. At least one fluid injection port is arranged in the tubular and is fluidically connected to the fluid conduit.

A method of treating and producing formation fluids from a formation includes introducing a first drop ball into a string of tubulars, pumping the first drop ball to a first ball seat, applying pressure to the first drop ball to shift a first sleeve exposing an outlet port, introducing a second drop ball into the string of tubulars, pumping the second drop ball to a second ball seat, applying pressure to the second drop ball to shift a second sleeve closing the outlet port and opening an inlet port and introducing a fluid directly onto at least one of the first and second drop ball through an injection port in the string of tubulars.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
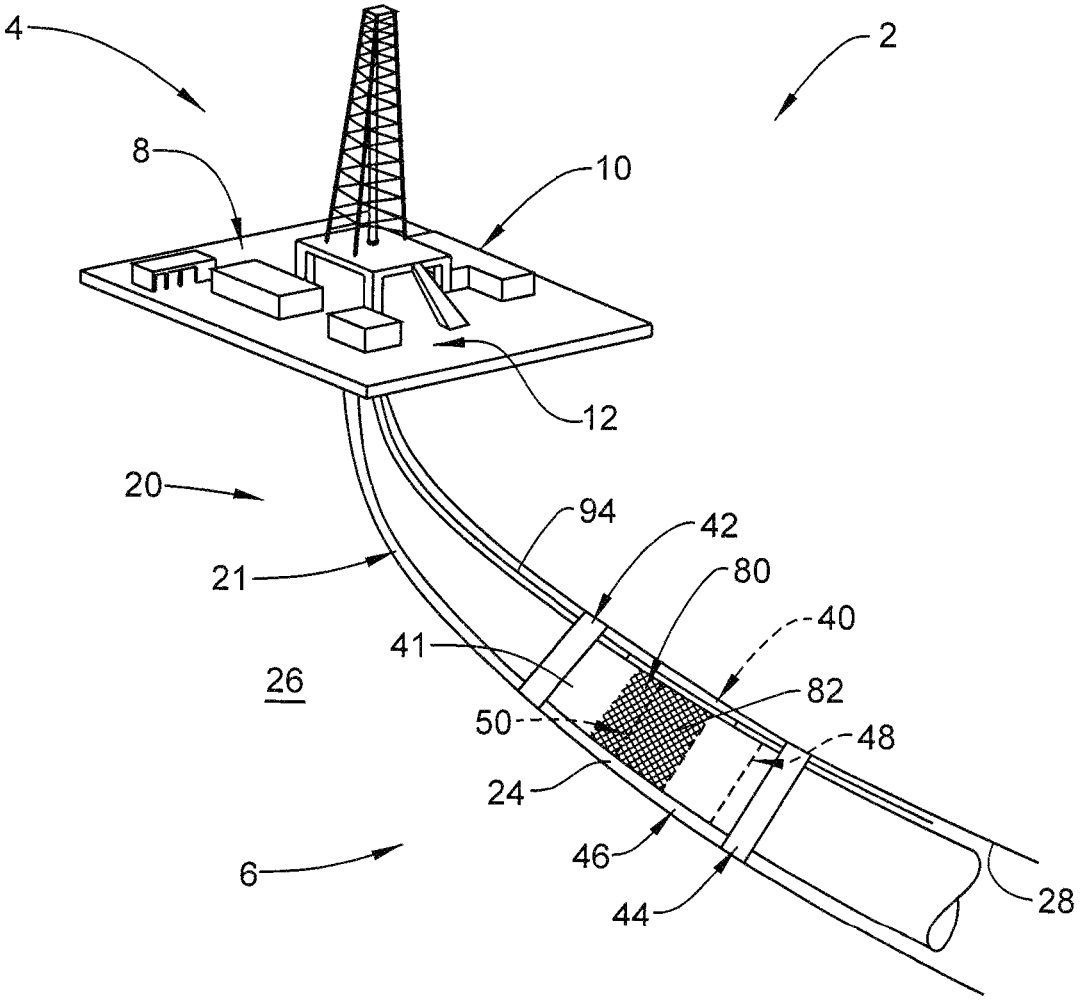
FIG. 1 depicts a resource exploration and recovery system including a ball activated treatment and production system, in accordance with an aspect of an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery of formation fluids, $CO_2$ sequestration, and the like. Resource exploration and recovery system 2 may include a first system 4 which, in some environments, may be a surface system operatively and fluidically connected to a second system 6 which, in some environments may be a downhole system. First system 4 may include pumps 8 that aid in completion and/or extraction processes as well as fluid storage 10. Fluid storage 10 may contain a completions fluid, a stimulation fluid or other type of fluid which may be introduced into second system 6. First system 4 may also include a control system 12 that may monitor and/or activate one or more resource exploration and recovery operations.

Second system 6 may include a tubular string 20 formed from a plurality of tubulars, one of which is indicated at 21 that is extended into a wellbore 24 formed in formation 26. Wellbore 24 includes an annular wall 28. Tubular string 20 may include a ball activated treatment and production system 40 arranged in a tubular 41 coupled to Tubular string 20 between a first packer 42 and a second packer 44. First and second packers 42 and 44 define a treatment and production zone 46 along wellbore 24. It should be understood that first packer 42 and/or second packers 44 may be arranged on tubular 41 together with ball activated treatment and production system 40 or may be arranged on other ones of tubulars 21. Ball activated treatment and production system 40 includes a first sleeve 48 slideably arranged within tubular 41 and a second sleeve 50 arranged upwardly relative to first sleeve 48. Second sleeve 50 is also slideably arranged in tubular 41.

Figure 2:
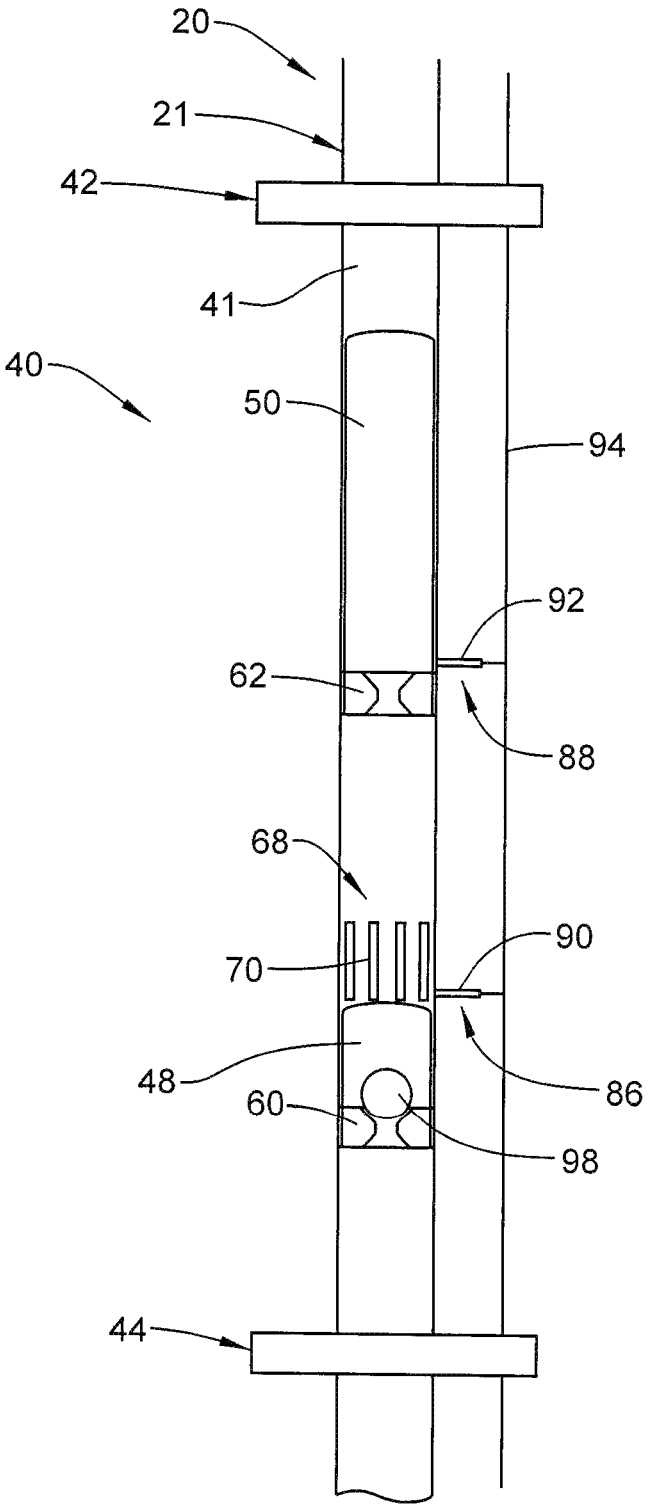
FIG. 2 is a cross-sectional schematic view showing the ball activated treatment and production system in a treating configuration, in accordance with an aspect of an exemplary embodiment.
Figure 3:
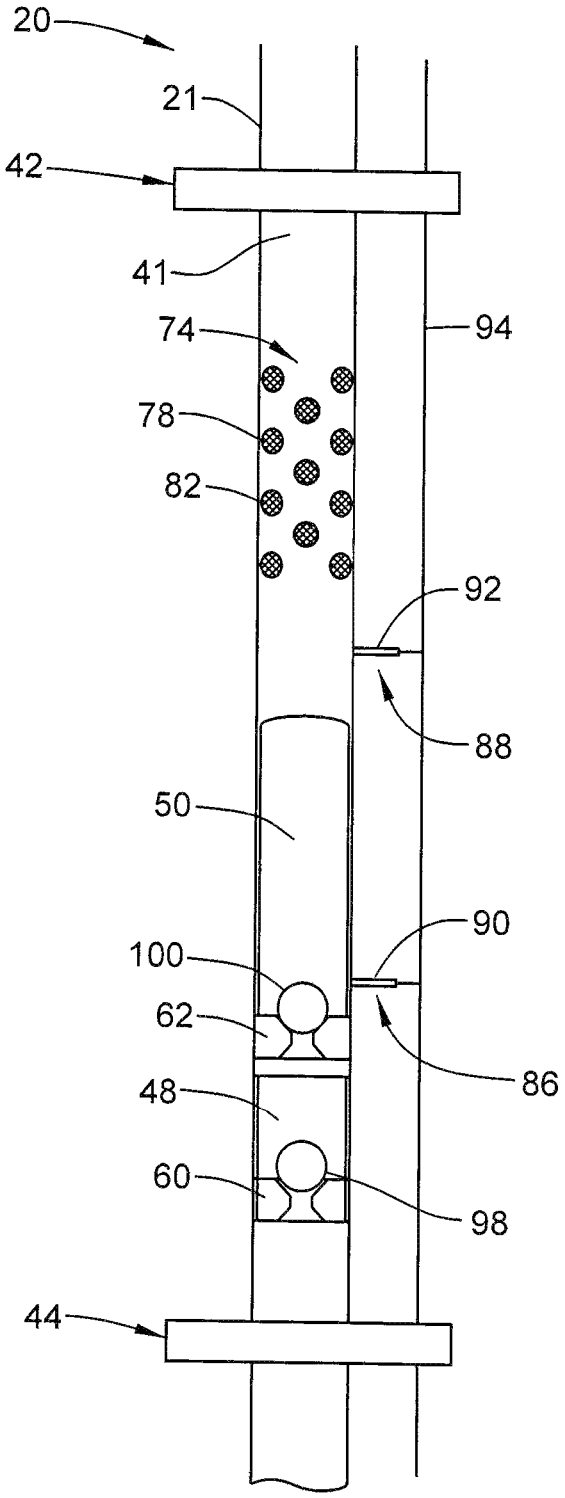
FIG. 3 is a cross-sectional schematic view showing the ball activated treatment and production system in a production configuration, in accordance with an aspect of an exemplary embodiment.

Reference will now follow to FIGS. 2 and 3, with continued reference to FIG. 1 in describing ball activated treatment and production system 40 in accordance with an exemplary aspect. First sleeve 48 include a first ball seat 60 and second sleeve 50 includes a second ball seat 62. First sleeve 48 is slideably positioned relative to an outlet port 68 defined by a plurality of outlet openings, one of which is shown at 70. Second sleeve 50 is slideably positioned relative to an inlet port 74 defined by a plurality of openings, one of which is indicated at 78. Inlet port 74 may include an inflow control device 80 that could take the form of a screen 82. Inflow control device 80 could take on other forms including labyrinth passages, controlled openings and the like.

First sleeve 48 may be shifted from a first position (FIG. 1) in which outlet port 68 is in a closed configuration to a second position (FIG. 2) in which outlet port 68 is an open configuration. In the open configuration, treatment fluids may be introduced from surface system 4 into formation 26. For example, a fracturing fluid may be introduced into formation 26 through outlet port 68 in order to stimulate production. Second sleeve 50 may be shifted from a first position (FIGS. 1 and 2) in which inlet port 74 is in a closed configuration, to a second position (FIG. 3) in which inlet port 74 is in an open configuration. In the second position, second sleeve 50 places outlet port 68 in a closed configuration. In this manner, following stimulation, formation fluids may pass through inlet port 74 via inflow control device 80 and flow to surface system 4.

In accordance with an aspect of an exemplary embodiment, ball activated treatment and production system 40 includes a first fluid injection port 86 arranged at first sleeve 48 and a second fluid injection port 88 arranged at second sleeve 50. First fluid injection port 86 is arranged upwardly relative to first ball seat 60 when first sleeve 48 is in the open configuration such as shown in FIG. 2. Second fluid injection port 88 is arranged upwardly relative to second ball seat 62 when second sleeve 50 is in the open configuration as shown in FIG. 3. First fluid injection port 86 may include a first selectively controllable valve 90 and second fluid injection port 88 may include a second selectively controllable valve 92.

First and second fluid injection ports 86 and 88 are fluidically connected to a fluid conduit 94 that extends to surface system 4. Fluid conduit 94 is arranged externally to tubular 41 and passes through at least first packer 44. Fluid conduit 94 may also extend toward a tow of well bore 24 (not separately labeled) through second packer 44 connecting to additional treatment and production zones (also not separately labeled).

In accordance with an exemplary aspect, a first drop ball 98 may be introduced into tubular string 20 and pumped down to first ball seat 60. Additional pressure may be applied to shift first sleeve 48 to the open configuration to start treatment of formation 26. When it is desired to initiate production, a second drop ball 100 is introduced into tubular string 20 and pumped down to second ball seat 62. Additional pressure may be applied to shift second sleeve 50 to the open configuration.

Prior to initiating production, it is desirable to remove first and second drop balls 98 and 100 from corresponding ones of first and second ball seats 60 and 62. In accordance with an exemplary aspect, first and second drop balls 98 and 100 are formed from a degradable material configured to react and degrade when exposed to a selected fluid. The particular type of fluid may vary. The selected fluid may be introduced into fluid conduit 94 and directed through first and second fluid injection ports 86 and 88 onto first and second drop balls 98 and 100. By providing the selected fluid directly to first and second drop balls 98 and 100, time needed for degradation may be greatly reduced. That is, instead of introducing a selected fluid into tubular string 20 at surface system 4, the selected fluid may be introduced directly into ball activated treatment and production system 40 to accelerate degradation and enable production.

Set forth below are some embodiments of the foregoing disclosure:

Embodiment 1

A ball activated treatment and production system arranged between a first packer and a second packer comprising a tubular including an inlet port, and an outlet port, a first sleeve selectively slideably arranged in the tubular, the first sleeve including a first ball seat and being arranged to selectively open the outlet port, a second sleeve selectively slideably arranged in the tubular, the second sleeve including a second ball seat and being arranged to selectively open the inlet port, and at least one fluid injection port arranged in the tubular and fluidically connectable to a fluid conduit arranged externally to the tubular.

Embodiment 2

The ball activated treatment and production system according to any prior embodiment, wherein the at least one fluid injection port includes a first fluid injection port arranged upwardly of the first sleeve and a second fluid injection port arranged upwardly of the second sleeve.

Embodiment 3

The ball activated treatment and production system according to any prior embodiment, wherein the at least one fluid injection port includes a selectively controllable valve.

Embodiment 4

The ball activated treatment and production system according to any prior embodiment, wherein the inlet port includes an inflow control device.

Embodiment 5

The ball activated treatment and production system according to any prior embodiment, further comprising a screen assembly arranged at the inlet port.

Embodiment 6

A resource exploration and recovery system comprising a surface system, a tubular string including a plurality of tubulars extending from the surface system, a first packer provided on one of the plurality of tubulars, a second packer arranged on one of the plurality of tubulars and another of the plurality of tubulars, the second packer being spaced from the first packer, a fluid conduit extending from the surface system through at least one of the first and second packers, a ball activated treatment and production system arranged between the first packer and the second packer, the ball activated treatment and production system comprising a tubular including an inlet port, and an outlet port, a first sleeve selectively slideably arranged in the tubular, the first sleeve including a first ball seat and being arranged to selectively open the outlet port, a second sleeve selectively slideably arranged in the tubular, the second sleeve including a second ball seat and being arranged to selectively open the inlet port, and at least one fluid injection port arranged in the tubular and fluidically connected to the fluid conduit.

Embodiment 7

The resource exploration and recovery system according to any prior embodiment, wherein the at least one fluid injection port includes a first fluid injection port arranged upwardly of the first sleeve and a second fluid injection port arranged upwardly of the second sleeve.

Embodiment 8

The resource exploration and recovery system according to any prior embodiment, wherein the at least one fluid injection port includes a selectively controllable valve.

Embodiment 9

The resource exploration and recovery system according to any prior embodiment, wherein the inlet port includes an inflow control device.

Embodiment 10

The resource exploration and recovery system according to any prior embodiment, further comprising a screen assembly arranged at the inlet port.

Embodiment 11

A method of treating and producing formation fluids from a formation comprising introducing a first drop ball into a string of tubulars, pumping the first drop ball to a first ball seat, applying pressure to the first drop ball to shift a first sleeve exposing an outlet port, introducing a second drop ball into the string of tubulars, pumping the second drop ball to a second ball seat, applying pressure to the second drop ball to shift a second sleeve closing the outlet port and opening an inlet port, and introducing a fluid directly onto at least one of the first and second drop ball through an injection port in the string of tubulars.

Embodiment 12

The method of any prior embodiment, wherein introducing the fluid includes injecting the fluid through a first injection port arranged upwardly of the first drop ball and a second injection port upwardly of the second drop ball.

Embodiment 13

The method of any prior embodiment further comprising selectively controlling the first and second injection ports.

Embodiment 14

The method of any prior embodiment, wherein introducing the fluid includes introducing a fluid selected to accelerated degradation of the at least one of the first and second drop balls.

Embodiment 15

The method of any prior embodiment, further comprising treating the formation through the outlet port and producing formation fluids through the inlet port.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A ball activated treatment and production system arranged between a first packer and a second packer comprising:

a tubular including an inlet port, and an outlet port;

a first sleeve selectively slideably arranged in the tubular, the first sleeve including a first ball seat and being arranged to selectively open the outlet port;

a second sleeve selectively slideably arranged in the tubular, the second sleeve including a second ball seat and being arranged to selectively open the inlet port; and a first fluid injection port arranged upwardly of the first sleeve and a second fluid injection port arranged upwardly of the second sleeve the first and second injection ports being fluidically connected to the first and second ball seats and fluidically connectable to a fluid conduit arranged externally to the tubular.

2. The ball activated treatment and production system according to claim 1, wherein the at least one fluid injection port includes a selectively controllable valve.

3. The ball activated treatment and production system according to claim 1, wherein the inlet port includes an inflow control device.

4. The ball activated treatment and production system according to claim 1, further comprising: a screen assembly arranged at the inlet port.

5. A resource exploration and recovery system comprising:

surface system;

a tubular string including a plurality of tubulars extending from the surface system;

a first packer provided on one of the plurality of tubulars;

a second packer arranged on one of the plurality of tubulars and another of the plurality of tubulars, the second packer being spaced from the first packer;

a fluid conduit extending from the surface system through at least one of the first and second packers;

a ball activated treatment and production system arranged between the first packer and the second packer, the ball activated treatment and production system comprising:

a tubular including an inlet port, and an outlet port;

a first sleeve selectively slideably arranged in the tubular, the first sleeve including a first ball seat and being arranged to selectively open the outlet port;

a second sleeve selectively slideably arranged in the tubular, the second sleeve including a second ball seat and being arranged to selectively open the inlet port; and a first fluid injection port arranged upwardly of the first sleeve and a second fluid injection port arranged upwardly of the second sleeve the first and second fluid injection ports being fluidically connected to the fluid conduit.

6. The resource exploration and recovery system according to claim 5, wherein the at least one fluid injection port includes a selectively controllable valve.

7. The resource exploration and recovery system according to claim 5, wherein the inlet port includes an inflow control device.

8. The resource exploration and recovery system according to claim 5, further comprising: a screen assembly arranged at the inlet port.

* * * * *